United States Patent [19]

Mokvist

[11] Patent Number: 4,911,791

[45] Date of Patent: Mar. 27, 1990

[54] APPARATUS FOR FORMING, PRESSING AND DRYING PAPER WEBS HAVING A FELT AND WEB RUN TO A YANKEE CYLINDER

[75] Inventor: Kurt Mokvist, Högsjö , Sweden

[73] Assignee: SCANDIAFELT AB, Hogsjo, Sweden

[21] Appl. No.: 235,749

[22] Filed: Aug. 22, 1988

Related U.S. Application Data

[63] Continuation of Ser. No. 3,385, filed as Pct SE86/00128 on Mar. 24, 1986, published as W086/05825 on Oct. 9, 1986, abandoned.

[30] Foreign Application Priority Data

Apr. 3, 1985 [SE] Sweden ..... 8501667

[51] Int. Cl.[4] ..... D21F 2/00; D21F 3/00; D21F 5/00; D21F 9/00

[52] U.S. Cl. ..... 162/290; 162/359; 162/360.1

[58] Field of Search ..... 162/348, 290, 358, 359, 162/360.1

[56] References Cited

U.S. PATENT DOCUMENTS

| | | | |
|---|---|---|---|
| 3,331,734 | 7/1967 | Rojecki | 162/359 |
| 3,560,333 | 2/1971 | Douglas et al. | 162/359 |
| 4,008,122 | 2/1977 | Welte | 162/359 |
| 4,139,410 | 2/1979 | Tapio et al. | 162/359 |
| 4,526,655 | 7/1985 | Karvinen et al. | 162/359 |

FOREIGN PATENT DOCUMENTS

| | | |
|---|---|---|
| 2004775 | 9/1970 | Fed. Rep. of Germany . |
| 2646555 | 4/1978 | Fed. Rep. of Germany . |
| 2721146 | 11/1978 | Fed. Rep. of Germany . |
| 1052754 | 1/1954 | France . |

*Primary Examiner*—Steve Alvo

*Attorney, Agent, or Firm*—Fleit, Jacobson, Cohn, Price, Holman & Stern

[57] ABSTRACT

A machine for producing thin paper web at high speed comprises a forming section (often called a twin wire former), a web transfer section (in which the formed sheet is transferred to the press felt), and a press roll over which the press felt with the web is turned so that the web presses against the warm Yankee cylinder, the web being formed between a felt—or a press fabric (2)—and a forming fabric (3). The forming unit, consisting of the felt and fabric, is placed in such a position in relation to the press roll (8) that the web (10), when separated from the forming fabric (3), is transproted on the top side of the felt (2) into a press nip against a Yankee cylinder (7) surface along a straight path tangentially to the Yankee cylinder surface.

6 Claims, 2 Drawing Sheets

APPARATUS FOR FORMING, PRESSING AND DRYING PAPER WEBS HAVING A FELT AND WEB RUN TO A YANKEE CYLINDER

This is a continuation of application Ser. No. 003,385, filed as PCT SE86/00128 on Mar. 24, 1986, published as WO86/05825 on Oct. 9, 1986, now abandoned.

BACKGROUND OF THE INVENTION

1 Field of the Invention

This invention relates to a machine for forming, pressing and drying of a thin paper web, which consists of a forming unit and at least one press roll press against the Yankee drying cylinder.

2. Description of the Prior Art

Modern Yankee machines for thin paper webs have the possibility of reaching speeds of about 2000 m/min when the web grammage is about 17 g/m$^2$. The machines consist of a forming section, often a so-called twin wire former, a web pick-up arrangement which transfers the formed web to a press felt, and a suction press roll over which the felt with the web is turned so that the latter is pressed directly against the heated Yankee cylinder. Normally a second "hot" press follows which in most cases is a blind-drilled roll. The web is then transported further on the cylinder under hot air blowing hoods until it is finally removed from the cylinder by a doctor.

This type of machine has many devices and functions that approach critical limits at high machine speeds. Such a one is the pick-up from the forming wire to the press felt, especially when the felt is new. The felt must have a smooth surface, a certain surface fiber fineness, density, and water content in order to function. If large water quantities must be applied to the felt in order to attain a good pick-up function, then this creates problems at the suction hot press. If instead a high vacuum is used for the pick-up roll, then this may result in suction of web fibers into the press felt which will then be clogged.

The paper web is transported towards the Yankee cylinder underneath the felt, which is also critical and may be jeopardized by a low felt water content, uneven felt surface, or an impermeable as well as too open felt.

The transport of this web around the suction hot press is very delicate at high speeds due to the high centrifugal forces that are created. This is therefore carried out at a high vacuum with large amounts of air.

If the water content of the web or the felt is too high, or if the vacuum is too low, part of the web will be cast away from the roll, necessitating a lowering of the speed.

It is well known that transporting the web in a special way to the presses without pick-up function and direction reversing over the rolls has been carried out with the so-called Periformer machines. On these machines the web is formed between the forming wire and the cylinder surface. The disadvantage with that is that forming in this way results in cooling the cylinder and that a large part of the cylinder circumference is used for forming so that only a reduced part remains for the drying of the web.

BRIEF SUMMARY OF THE INVENTION

The object of this invention is to overcome the above disadvantages by providing a machine which makes it possible to maintain a high machine speed without causing the above operating problems and is characterized by novel features for forming a paper web between a press felt (or press fabric) and a forming fabric, the forming unit with the felt and forming fabric being placed in such a position in relation to the first press roll that the web, when separated from the forming fabric can be led against the Yankee cylinder surface along a straight track.

BRIEF DESCRIPTION OF THE DRAWINGS

One embodiment of the invention will now be described in greater detail with reference to the accompanying drawing wherein.

DETAILED DESCRIPTION

The machine includes a headbox 1 for the stock and a forming unit consisting of a felt 2 and a forming fabric 3, which run together over a forming roll 4.

Figure 1:
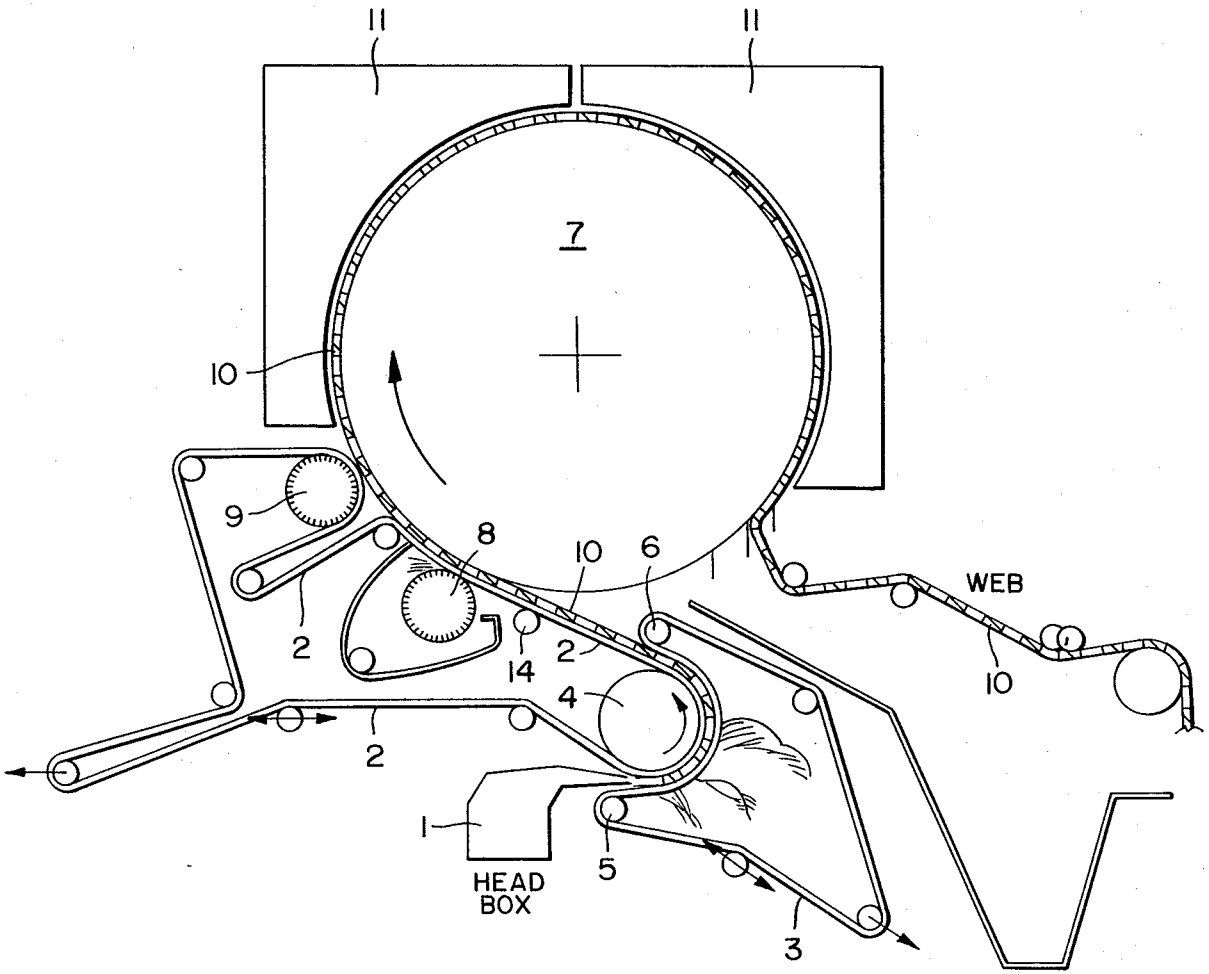
FIG. 1 is a schematic side elevational view of a machine according to the invention.

The felt transports the web forward to the Yankee cylinder 7. Press roll 8 presses the felt 2 and web 10 against this cylinder 7. Another press roll 9 is provided and these press rolls are advisedly in the form of so-called blind-drilled rolls. As seen in the drawing the felt 2 takes off from the Yankee cylinder between the two press rolls by two felt rolls. As shown in FIG. 1, the remainder of the path line is determined by turning and stretching rolls not described in detail, which return the felt to the headbox and forming roll 4.

The forming fabric 3 is turned up from the press felt 2 around a reversing roll 6 placed in front of the press nip, and the felt 2 runs in a straight path from forming roll 4 in the forming unit to the press roll 8.

After the press roll 8, the web 10 separates from the felt 2 and transfers to the Yankee cylinder. The Yankee cylinder is partially encapsulated in hot air hoods 11 in the illustrated embodiment. As shown in FIG. 1, the web 10 is transferred from the Yankee cylinder right after the last hot air hood.

As illustrated by the above description, transfer from the forming fabric 3 and direction reversing at the first press roll 8 is eliminated. In addition, the forming unit is composed of a double former, in which the forming of the web takes place between the fabric and the felt and the formed web is then transported further by the felt to the first press nip between the Yankee cylinder 7 and the press roll 8. This eliminates entirely the transferring in a traditional manner. The forming unit is placed so that the web lies on the top side of the felt and can be drawn a short way without direction change into the first press nip, which is the reason it does not have to be constructed as a suction press, which is common with present day techniques.

In some cases, for example when rebuilding old machines, the rebuilding can be facilitated by changing the ideal felt/web draw between the forming roll 4 and press roll 8. This can be done by fitting a support roll 14 which allows a slight change in direction.

As a result of the short stretch of felt and web from the forming unit to the press, it comes into the cylinder with a higher temperature, which reduces the cooling of the cylinder and saves energy. Additional energy is saved since vacuum is unnecessary at the first press roll.

An additional advantage is that the felt can be constructed with pressing functions in mind, which should result in a better dewatering in the presses with resultant additional energy savings. Felt cleaning is reduced by the elimination of pick-up, which means that no cellulose fibers, from the web, are sucked into the felt.

Figure 2:
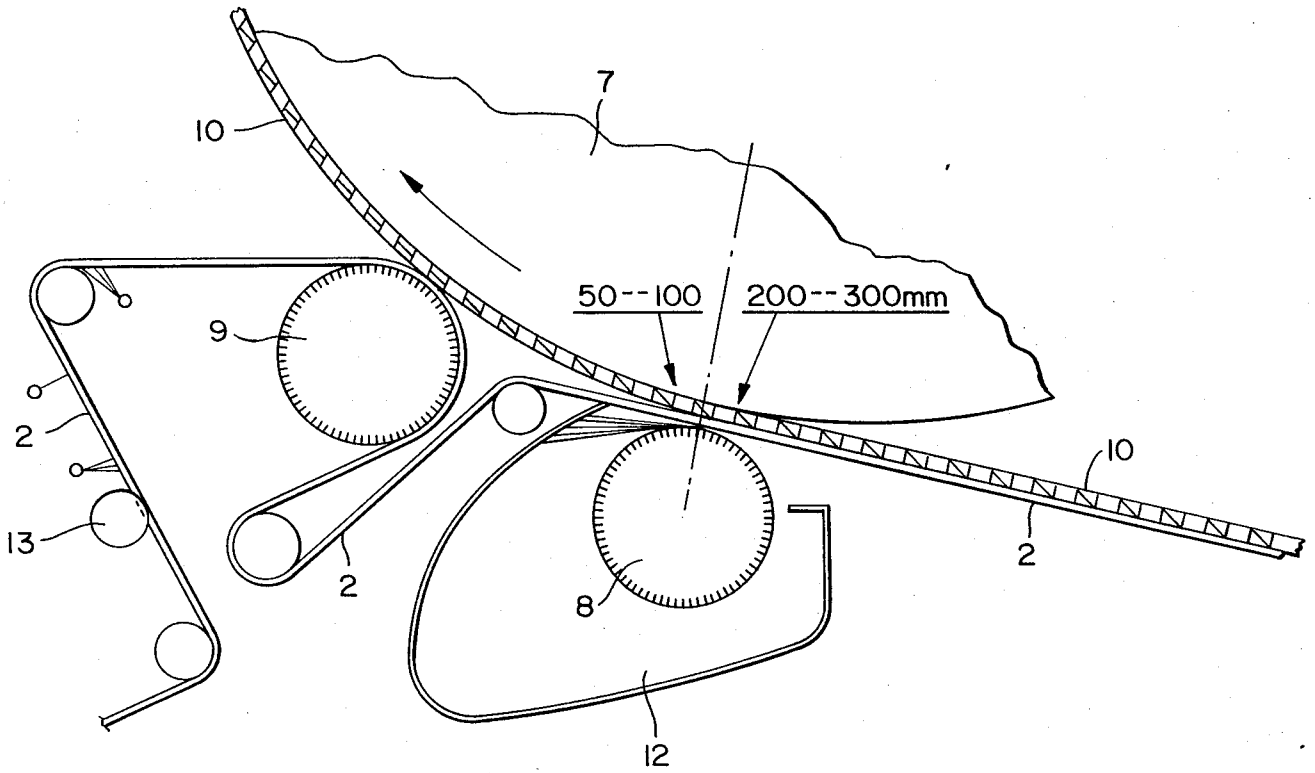
FIG. 2 is an enlarged view of part of FIG. 1 showing features of the invention more clearly.

FIG. 2 shows Yankee cylinder 7 and press rolls 8 and 9 an a large scale. As can be seen, the first press roll 8 has a trough 12 for water drainage, and additionally a felt conditioning unit 13 is located after the last press roll 9 in relation to the felt 2 running direction. Additionally shown is the transfer area between the felt and Yankee cylinder located before the tangent point between press roll 8 and Yankee cylinder 7, which is 200–300 mm, while transfer area after the tangent point is 50–100 mm.

Within the scope of the claims there may be variations in addition to the embodiment described above. Consequently the forming unit can be differently constructed and dimensioning for forming fabric and felt can vary with consideration, however, of the felt line dimension between the point where the forming fabric leaves the felt and the first press nip.

I claim:

1. In a machine for forming, pressing and drying of thin paper webs having a forming unit, comprised of a forming roll, a press fabric means and a forming fabric means which run together for forming the web between the press fabric and forming fabric, a Yankee cylinder over which the formed web passes, and at least one press roll urged against the Yankee cylinder forming downstream of the forming unit a press nip therebetween through which the press fabric and web pass, the press fabric having an upper side and a lower side, the improvement wherein:

the forming unit is disposed relatively to the at least one press roll so that the formed web is transported on the upper side of the press fabric into said press nip after the web is separated from the forming fabric, and the press fabric extends substantially in a straight path between the forming unit and the at least one press roll and tangentially with respect to the Yankee cylinder in said press nip;

forming fabric separating means is disposed between said forming unit and the at least one press roll for separating the forming fabric from the web; and a forming roll is provided in the forming unit over which the press fabric and forming fabric run together so that said forming roll is common to the press fabric and forming fabric and so that said substantially straight path of the press fabric extends from the outer peripheral surface of said forming roll.

2. A machine as claimed in claim 1 wherein:

said forming fabric separating means comprises a forming fabric reversing roll disposed above the upper side of the press fabric and over which the forming fabric runs.

3. A machine as claimed in claim 1 wherein:

said press fabric comprises a felt.

4. A machine as claimed in claim 2 wherein:

said press fabric comprises a felt.

5. A machine as claimed in claim 1 wherein:

the Yankee cylinder and the at least one press roll have radii which are colinear; and said substantially straight path of the press fabric is substantially perpendicular to said radii at said press nip.

6. A machine as claimed in claim 4 wherein:

the Yankee cylinder and the at least one press roll have radii which are colinear; and said substantially straight path of the press fabric is substantially perpendicular to said radii at said press nip.

* * * * *